United States Patent [19]

Franklin et al.

[11] 3,981,254

[45] Sept. 21, 1976

[54] AUTOMATIC NECKTIE NECKBAND TACKER

[75] Inventors: Stanley Franklin, Northridge, Calif.; Herbert Jaffe, New York, N.Y.

[73] Assignees: Stanley Franklin, Los Angeles, Calif.; Herbert Jaffe, New York, N.Y.; Harold Athey, Los Angeles, Calif. ; part interest to each

[22] Filed: Dec. 29, 1975

[21] Appl. No.: 645,197

[52] U.S. Cl. ..... 112/104; 112/114; 112/252

[51] Int. Cl.² ..... D05B 3/12

[58] Field of Search ..... 112/104, 114, 88, 99, 112/100, 101, 207, 70, 76, 252

[56] References Cited

UNITED STATES PATENTS

| | | | |
|---|---|---|---|
| 1,199,822 | 10/1916 | Rosenthal et al. | 112/104 |
| 1,319,450 | 10/1919 | Allen et al. | 112/252 X |
| 1,785,412 | 12/1930 | Hatfield | 112/252 |
| 2,356,665 | 8/1944 | Gunther | 112/114 |
| 2,410,399 | 10/1946 | Wood | 112/114 |

*Primary Examiner*—H. Hampton Hunter
*Attorney, Agent, or Firm*—Martin A. Farber

[57] ABSTRACT

An automatic necktie neckband tacker, comprising a guage having inner peripheral edges defining an opening substantially equal to the size of a neckband for securing a neckband therein, an upper clamp forming a clamp opening therein substantially equal to the opening of the gauge and aligned therewith, the upper clamp moveably disposed above the guage constituting a clamping unit therewith for clamping therebetween a tie at a neck area thereof adjacent the neckband, and a clamp and cutting blade carrier for clamping and cutting, respectively, an upper needle thread. The upper clamp has a formation for guideably mounting the clamp and cutting blade carrier for movement of the latter upon actuation thereof into a withdrawn position under the upper clamp, as well as into an operative position projecting into the clamp opening. A pneumatic cylinder is operatively mounted on said upper clamp moveably jointly therewith, for actuating the clamp and cutting blade carrier.

7 Claims, 14 Drawing Figures

FIG. 1
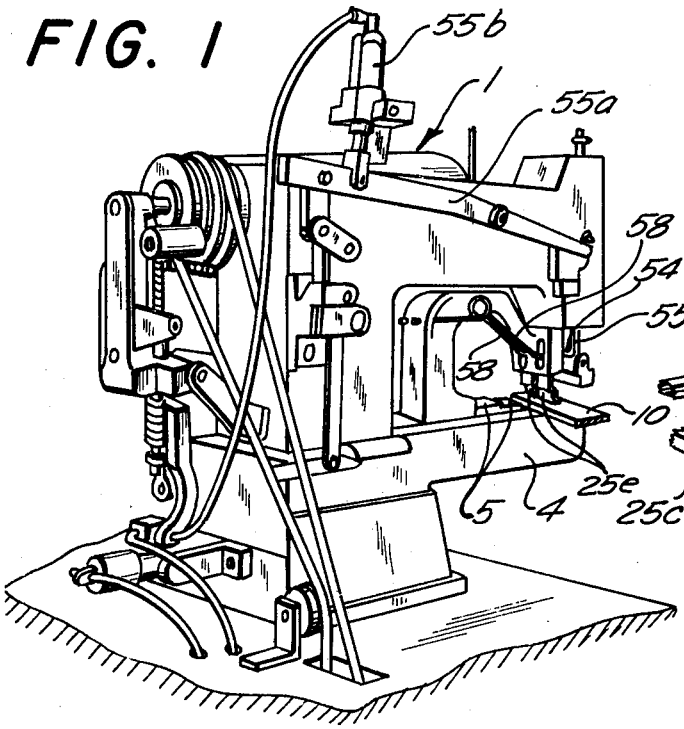
FIG. 2
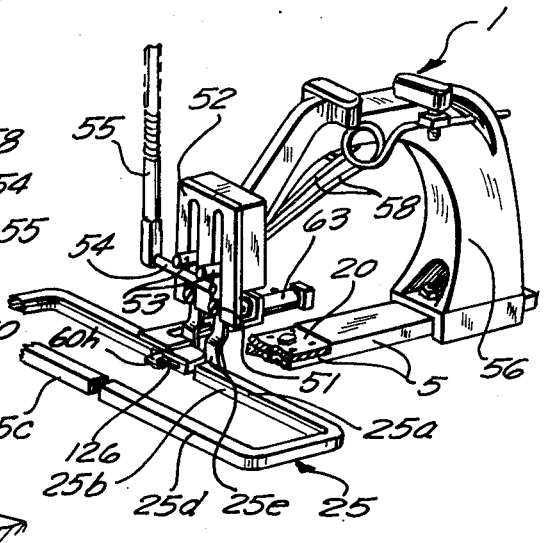
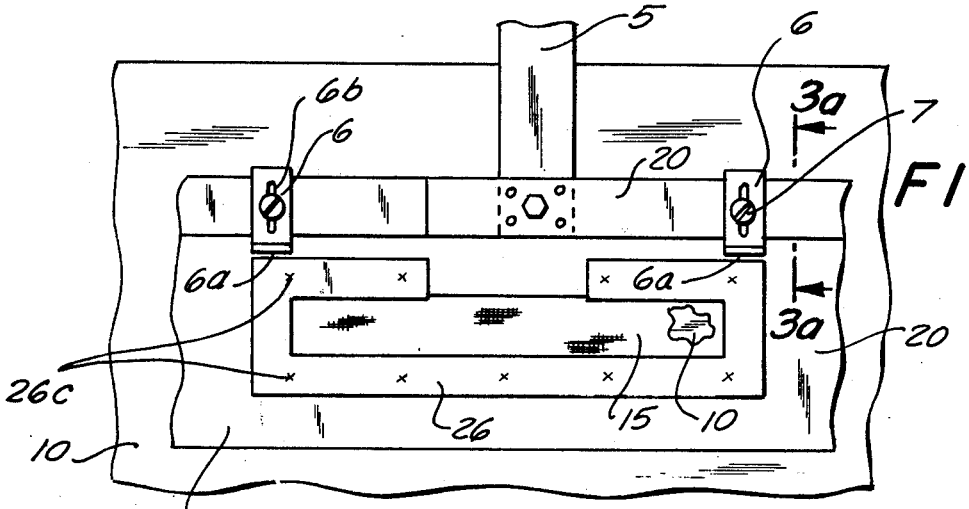
FIG. 3
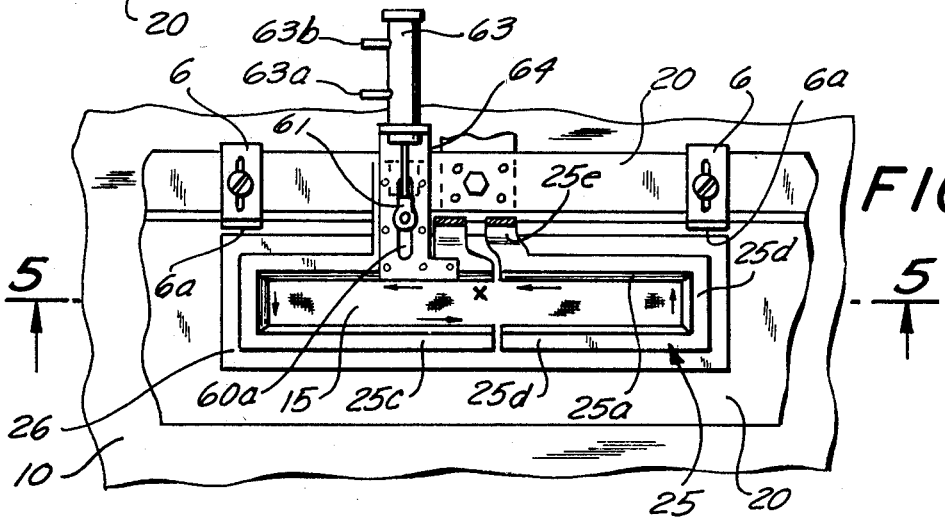
FIG. 4

PRESSURIZED AIR SOURCE AND CONTROL

FIG. 8
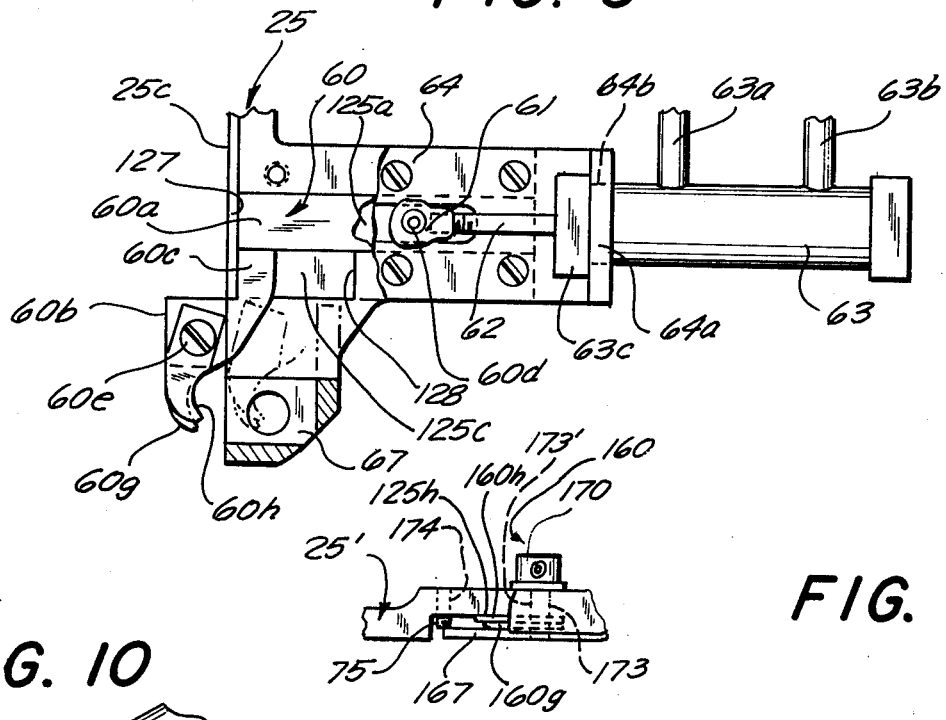
FIG. 11
FIG. 10
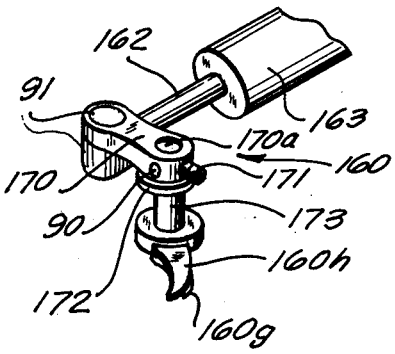
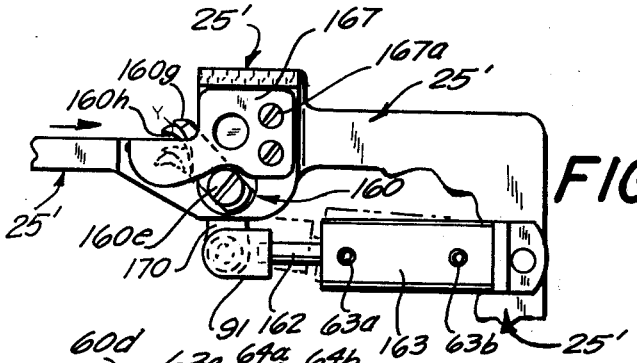
FIG. 12
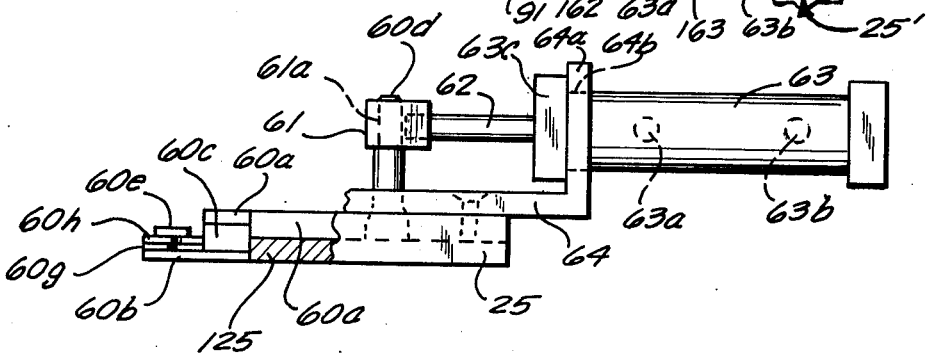
FIG. 9

AUTOMATIC NECKTIE NECKBAND TACKER

The present invention relates to an automatic necktie neckband tacker.

The advantages of having neckbands sewed into the neck area of a necktie have long been established. Briefly, it keeps the inner lines and inner tapes from slipping, marks the location for the wearer's neck, adds durability to the area of the necktie which gets the most wear, keeps the tie flat underneath the collar, prevents the tie from falling out and elongating, and prevents any possible slippage of the lining inside the tie. Further, it adds strength and durability to the tie, is attractive and when printed with the seller's or manufacturer's name or trademark, it is readily and continually noticed by the consumer and therefore is an excellent means of sales promotion.

Although these advantages have long been recognized, the problem of sewing a neckband on each tie has heretofore always been that the neckband was required to be sewn on with a single or double needle machine by an experienced operator. It was a very slow time consuming operation, and therefor extremely expensive. Moreover the large length to width and thickness ratio of the neckband which is to be tacked in the neck area of a tie offered heretofore insurmountable problems to production of a reliable automatic neckband tacker. The result of these disadvantages has been that neckwear manufactures have long ago discontinued the use of neckbands in their ties for the most part.

Accordingly it is an object of the present invention to provide for the first time a new and improved automatic necktie neckband tacker which avoids the above-disadvantages, and provides an excellent neckband tacking with accompanying reduced manufacturing labor, time and expense, enabling neckband tacking with extreme speed and low cost using inexperienced help, and once again allowing neckbands to become a permanent part of a necktie with all the advantages thereof.

In accordance with the above-mentioned object of the invention there is provided, in accordance with a still further object of the invention to so provide, an automatic necktie neckband tacker comprising a special upper clamp and a cooperating special work plate on the bottom which is formed to fit exactly in two-part alignment to the size of the neckband, the upper clamp holding the tie on the neckband securely in the clamped lowered position thereof so that no movement or slippage occurs.

Further, in accordance with the above-mentioned objectives, as well as another object of the invention, there is provided by the invention a special upper thread blade built into the movable upper clamp for cutting the needle thread.

Still further in accordance with another object of the invention a small pneumatic cylinder for operating the upper thread blade is carried by the upper clamp adjacent the upper thread blade, the latter designed also for holding the upper thread in place for the first few stitches so as to commence sewing, the blade automatically cutting the thread leaving no loose ends to be cut with scissors when the entire sewing is completed, the upper clamp then raising to release the tie.

Since the cam must be very large to accomplish the very large number of stitches required for elongated tie neckband rectangular perimeters (e.g., 7¼ by ⅞ inch), it is too big to activate the conventional nipper spring of sewing machines, and in accordance with another object of the invention the upper thread carrier is designed to perform the two functions of cutting the thread and holding the thread for the first few stitches to start the sewing so that the needle would not unthread when the machine is activated.

With the above and other objects in view, the invention will become better understood in connection with the following description of preferred embodiments in connection with the accompanying drawings, of which:

FIG. 1 is a perspective view of a tacking machine of the general type to which the present invention can be used in combination therewith, the clamp feet being broken away, not illustrating the clamp therein;

FIG. 2 is a perspective view of a portion of the machine of FIG. 1 showing the upper clamp in accordance with the invention partly broken away;

Figure 5:
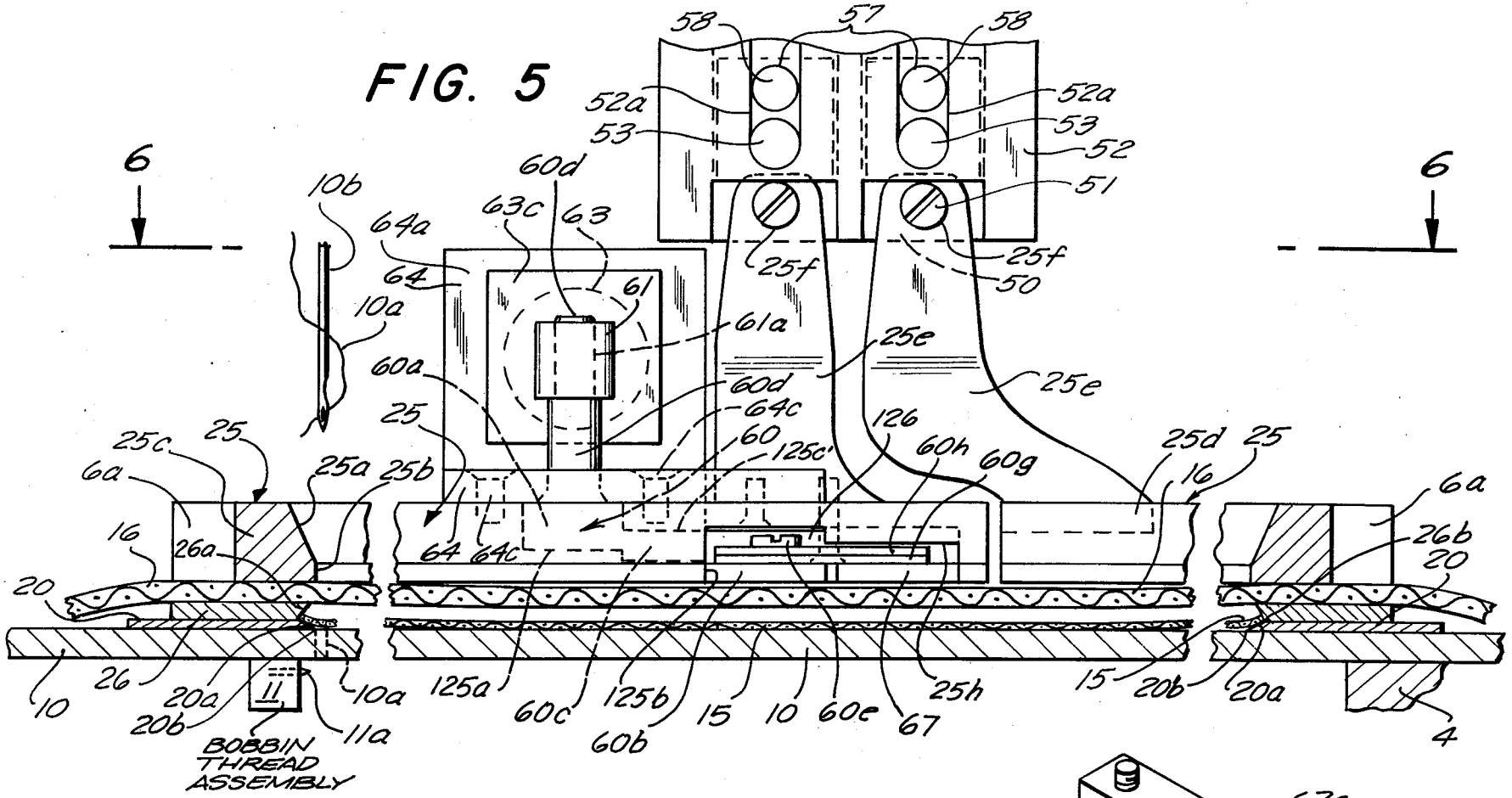
Figure 5A:
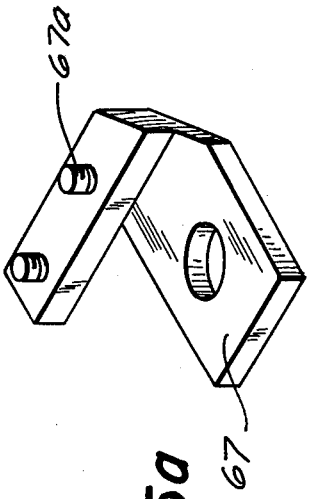
Figure 3A:
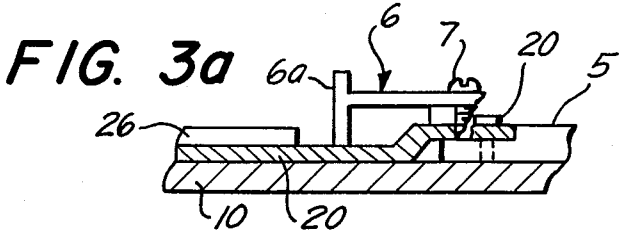
FIG. 3 is a top plan view broken away in part of the lower portion of the operative clamp.
Figures 6, 7:
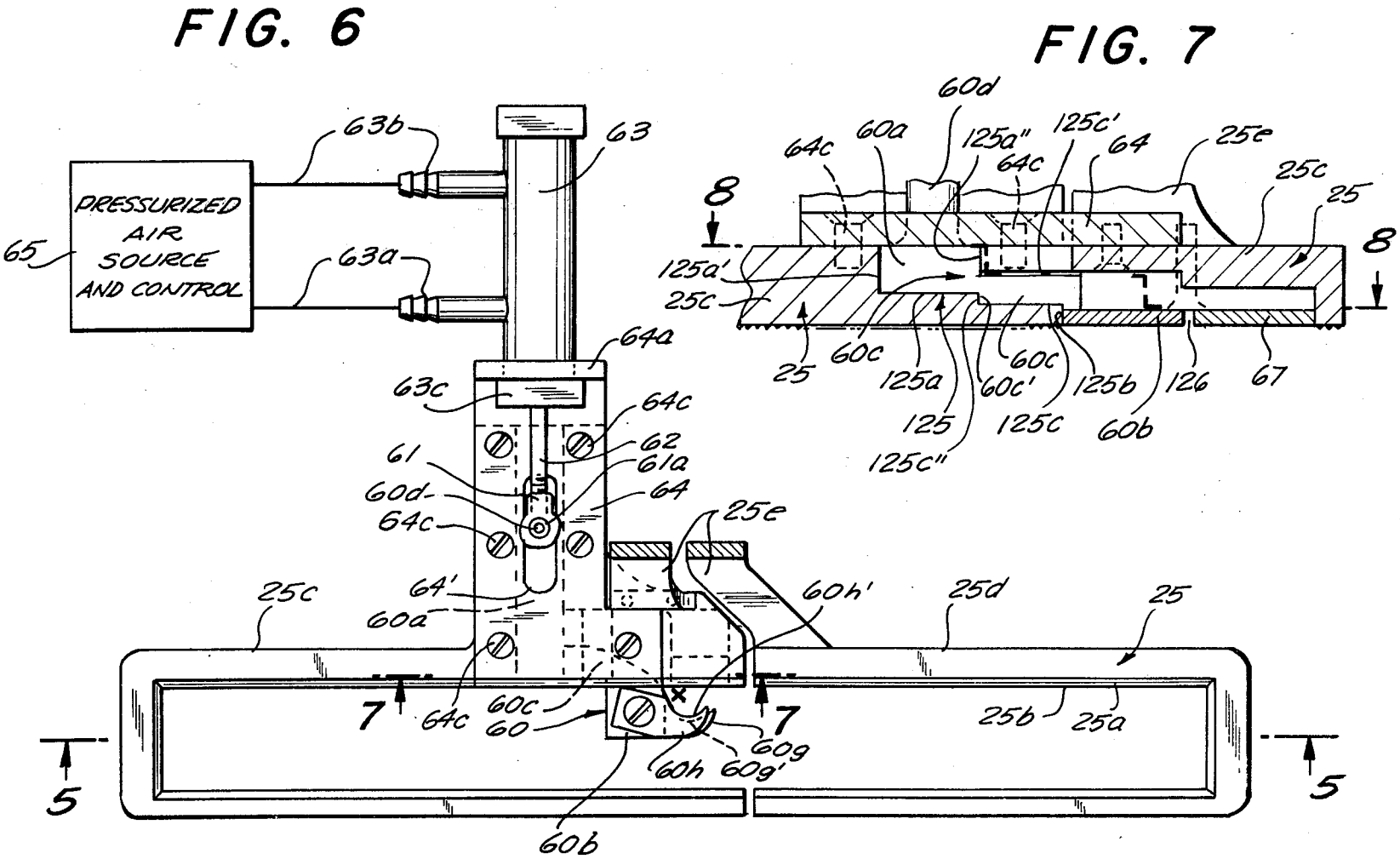

FIG. 3*a* is a section taken along the lines 3 — 3 of FIG. 3;

FIG. 4 is a top plan view similar to FIG. 3, and showing the upper clamp positioned thereon;

FIG. 5 is a section taken along the lines 5 — 5 of FIG. 4 in enlarged view, partly broken away, and showing a tie clamped therein;

FIG. 5*a* is a perspective view of the counter cutting plate;

FIG. 6 is an view taken along the lines 6 — 6 of FIG. 5, and similar to FIG. 4 but omitting some parts thereof, but showing the upper clamp and upper thread blade carrier;

FIG. 7 is a section taken along the lines 7 — 7 of FIG. 6;

FIG. 8 is a plan view of the portion of the upper clamp having the carrier, being partly broken away and turned 90° from that of FIG. 5 for illustration purposes only;

FIG. 9 is a side elevation view showing the carrier of FIG. 8, the view being partly broken away;

FIG. 10 is a perspective view of another embodiment of the upper blade carrier;

FIG. 11 is a front elevational view partly broken away (similar to the view direction of FIG. 5), but showing the carrier of FIG. 10 operatively disposed in the upper clamp;

FIG. 12 is a bottom view looking upwardly of FIG. 11.

Referring now to FIGS. 1 – 9 of the drawings, the neckband or label tie tacker in accordance with the present invention is formed on any otherwise conventional flat bed tacking machine 1, preferably such as a Pfaff 3135 and includes a special upper clamp 25 having a rectangular inner peripheral edge 25*a*, 25*b* formed substantially complementary to a rectangular label or neckband 15 which is to be sewed into the neck area of a tie 16, its innermost edge 25*b* being slightly smaller than the neckband by the amount of the sewing margin less ½ of the thickness of the needle 10*b*. Under the clamp 25 is a needle plate 10 having therein a needle opening 10*a* (FIG. 5) which cooperates during operation with the sewing needle 10*b*, the latter being operatively connected to the sewing machine in any conventional manner and carrying the needle thread 10*c*. Under the needle opening 10*a* in the needle plate 10, there is as conventionally connected to the latter, a bobbin thread assembly 11 (schematically illustrated) including the conventional bobbin thread knife 11*a*.

The bobbin and bobbin holder are conventional and are not illustrated. The needle plate 10 except for the small needle opening 10*a* is flat and constitutes a solid support without openings and is rigidly screwed onto the casting or bed 4 of the machine 1. A lower work plate 20 is freely moveably disposed on the needle plate 10, the work plate 20 being secured to a feed bar 5, the latter lying flat on the rear portion of the needle plate 10 yet moveably disposed relative thereto. The feed bar 5 is also rigidly screwed to the arch clamp frame 56 of the clamp 25. The lower work plate 20 is formed with a continuous inner peripheral edge 20*a* defining a substantially rectangular opening, substantially complementary in rectangular shape to that defined by the neckband 15 as well as to the inner peripheral edge 25*a* of the upper clamp 25 and aligned substantially therewith.

A gauge 26 of about twice the thickness of the lower work plate 20 is preferably riveted to the latter by rivets 26*c* and is likewise formed with an inner peripheral edge 26*a* substantially defining an opening complementary to the neckband 15 and substantially aligned with inner peripheral edges 25*a* and 20*a* of the upper clamp 25 and the lower work plate 20, respectively. The inner peripheral edge 20*a* of the lower work plate 20 is tapered inwardly and downwardly at about 30 degrees or less to the horizontal forming an innermost extremity 20*b*, which is aligned substantially with the vertical inner extremity 25*b* of the likewise downwardly inwardly tapered edge 25*a* of the upper clamp 25. To the contrary, the inner peripheral edge 26*a* of the gauge 26 is slightly inclined with an upward inwardly directed taper, with its lower outermost portion 26*b* meeting the upper outwardmost portion of the inclined inner peripheral edge 20*a* of the lower work plate 20.

These oppositely inclined edges 20*a* and 26*a* cooperate with a neckband 15 positioned therein for proper support alignment for the tacking operation onto the tie. Since the neckband 15 to be sewed by the arrangement of the present invention is greatly elongated and made of a thin textile material, the particular shape of the cooperating inclined edges 20*a*, 26*a* are advantageously essential for the proper securing of the neckband 15 to the narrow neckband portion of the tie 16. As shown in FIG. 5, the peripheral edge of the neckband 15 abuts the substantially vertical but upwardly narrowing inner edge 26*a*, gently holding the neckband 15 on its entire periphery, and with the gently sloping inwardly inclined edge 20*a* of the lower work plate 20 standing available to support the directly adjacent portion of the neckband 15 in a shape substantially paralleling the concave shape of the neckband 15 depending toward the needle plate 10.

When a tie 16 is clamped between the upper clamp 25 and the guage 26, as will hereinafter be explained, and sewing is initiated, this positioning of the neckband 15 by the cooperating peripheral edges provides an accurate uniform sewing of the neckband around its entire periphery onto the neck area of the tie, with the sewing thread 10*c* completely automatically sewing a perfect tacking very close to the peripheral edge of the neckband. The needle 10*b* and the needle opening 10*a* in the needle plate 10 are aligned adjacent the inner peripheral edges of the members 20, 26 as well as the clamp 25, forming the neckband opening.

The upper clamp 25 is particularly formed in two asymmetrically off-set inverted facing U-shaped parts 25*c* and 25*d* cooperating to define therein the complementary rectangular opening for the neckband edge tacking. The clamp 25 has a width smaller than that of the gauge. The clamp 25 is divided into the two clamp parts 25*c* and 25*d* at a point along the longer sides of the rectangular shaped opening. At the rear portion of the clamp parts adjacent the clamp division, each clamp part 25*c* and 25*d* is formed with an integrally depending foot 25*e* which extends upwardly and is formed with a hole 25*f* at its upper end for connection each to a pin plate 50 by means of flat head screws 51 passing through the holes.

Each plate 50 is formed with a pin 53 integrally extending horizontally therefrom and passing through a vertical elongated opening 52*a* in a front cover plate 52.

The pins 53 are disposed cooperatively below a horizontal lifting projection 54 of a spring biased vertical lifting rod 55, the latter being operatively connected to a lifting lever 55*a* which in turn is connected to a large pneumatic air cylinder 55*b* for actuating the lifting lever 55*a*. This consequently causes the lifting projection 54 of the vertical rod 55 to simultaneously lift both pins 53, and therewith both plates 50, which are secured to the respective feet 25*e* of the two clamp parts 25*c* and 25*d*, thereby lifting both of the clamp parts together upwardly away from the gauge 26. In this open position of the clamp, a new neckband 15 may be inserted into the opening in the gauge 26 and a tie 16 positioned with its neck area over the gauge, and with the lateral edge of the tie abutting the adjustable tie abutments 6 against the abutment surfaces 6*a* thereof, the tie abutments 6 being formed for this purpose with elongated slots 6*b* through which a screw 7 is adjustably disposed to allow displacement of the abutments 6 as may be desired along the direction of the slots 6*b* upon loosening of the screws 7.

After the tie 16 is properly positioned on the gauge 26, then the lifting lever 55*a* is disengaged from the holding-open force of the pneumatic cylinder 55*b*. Clamping springs 58 which are operatively connected on one end to the machine arm 56 and at their other ends to the plates 50 in openings 57 thereof, press the clamp parts 25*c* and 25*d* downwardly in operative clamping position as illustrated in FIG. 5, when the pneumatic cylinder 55*b*, lifting lever 55*a* and lifting rod 55 are not actuated and inoperative. The pneumatic cylinder 55*b*, lifting lever 55*a* and lifting rod 55 when actuated open the clamping parts against the clamping force of the clamping springs 58.

The dividing of the clamp 25 into the two parts 25*c* and 25*d* which are off-set unsymmetrically aids the excellent tacking of the neckband to the tie by offering the operator flexibility in positioning ties at the neck area which may have slightly varying cloth thicknesses. An advantageous pressing of the tie is achieved by each clamping spring 58 pressing the respective foot 25*e* at the adjacent center of the clamp 25, as well as other advantages: The greater clamping force thus is adjacent the feet 58*e* and a desired resilience is achieved at the ends of the elongated clamp parts, with differing magnitudes depending on the selection of the respective springs, as well as on the respective lengths of the differently sized clamp parts. The operator has the option to choose that direction of laying of the tie which under the circumstances provides the best tacking of the neckband 15 to the particular tie 16.

In operation, when the tie 16 is clamped by the clamp 25, the machine 1 moves the clamp 25 such that the inner peripheral edge 25*b* of the clamp 25 travels adjacent the fixed position of the needle 10*b*, the clamp describing a rectangular movement of travel substantially equal to the periphery of the neckband 15. This is achieved by a large cam and cam follower mechanism which is well known per se for moving work along various tracks, and which is readily designed to achieve the rectangular track movement required for neckbands herein, which neckbands are of a very large size.

The clamp part 25*c* is formed to have built therein an upper thread cutting blade and clamp carrier 60 adjacent the middle of the clamp 25 near the division thereof into the two U-shaped clamp portions 25*c* and 25*d* and next to the corresponding foot 25*e* where the lifting and closing forces are the strongest. The clamp part 25*c* is formed with a stepped channel 125, constituting a guide means and recess means, in a channel portion 125*a* of which an elongated slide portion 60*a* of the carrier 60 is longitudinally displaceably disposed. An inward facing portion of the clamp part 25*c* is formed with an opening of the recess means, namely opening 126, through which an upper needle thread clamp and cutting blade portion 60*b* of the carrier 60 projects in the operative thread clamping and cutting position into the neckband clamp opening. The portion 60*b* is integrally a part of the carrier 60 and is joined to the slide portion 60*a* by a lateral web portion 60*c*.

A carrier pin 60*d* integrally extends vertically from the upper side of the slide portion 60*a* and passes through an elongated opening 64′, parallel to the channel portion 125*a* and the longitudinal extent of the elongated slide portion 60*a*, and is formed in a cover 64, permitting longitudinal displacement of the slide portion 60*a* in the channel portion 125*a*. The cover 64 is screwed by means of screws 64*c* or the like for ready removal for servicing, into the top of the clamp part 25*c* over the slide portion 60*a*, the cover being formed with an upwardly depending flange 64*a* having an opening 64*b* through which the pneumatic cylinder 63 is secured and supported. The pneumatic cylinder 60 has compressed air control lines 63*a* and 63*b* connected to a pressurized air source and control 65. The carrier pin 60*d* projecting over the cover 64 through the opening 64′ is operatively disposed through an opening 61*a* in a universal linking member 61, the latter being screwed into the operative piston 62 of the pneumatic cylinder 63. An adjustable nut 63*c* is provided for limiting the operative stroke of the piston 62 of the pneumatic cylinder 63. The pneumatic cylinder 63 is carried by the cover 64 adjacent the corresponding foot 25*e* of the larger clamp part 25*c* along with the opening and closing movements of the upper clamp where the forces therefor are most effective for the added weight of the cylinder 63 and carrier 60.

In operation, when a tie 16 is clamped between the clamp 25 and the gauge 26, the tacking starts at the position marked X in FIG. 4 and the cam and cam follower mechanism (not shown) which are operatively connected to the feed bar 5 cause the latter to move the arch 56 and therewith the clamp 25 (as well as jointly therewith the lower work plate 20 and the gauge 26) so that the tacking path follows the arrow path, as shown. Actually on starting, the tacking goes one stitch to the right (opposite to the arrows) and then back in the direction of the arrows continuing completely around and then going over this one first stitch once more before stopping again at X. Before the beginning of the tacking operation, that is, at the end of the previous tacking (if any), the carrier has cut the top or needle thread 10*c* and remains in that position holding the thread 10*c* for the starting of the new tack, i.e., the carrier 60 being withdrawn (as indicated in dashed lines in FIG. 8) by the pneumatic cylinder 63 sending pressurized air through line 63*a* thereto which pulled the carrier portion 60*b* including the blades thereof rearwardly and completely into the opening 126 inside the clamp part 25*c*, via the universal linking member 61 and the carrier pin 60*d*, the latter extending upwardly and displaceably through the elongated opening 64′ in the cover 64. Thus the beginning tacking passes by the withdrawn blade cutter carrier 60 without interference. After the tacking has passed the position of the carrier 60, the pneumatic cylinder 63 is tripped by the pressurized air control 65 via a cam sensor (not shown) in the movement path and the compressed air line 63*b* passes the pressurized air to the cylinder 63. This causes the piston 62 to move forwardly and to therewith carry the universal 61 and the carrier pin 60*d*, thereby extending the carrier 60 with its thread clamp and cutter blade portion 60*b*, the latter having a cutter blade 60*g* and a thread clamp plate 60*h* held thereon by screw 60*e*, into the tracking path, as shown in FIGS. 6 and 8. The sewing continues until the entire periphery of the neckband 15 has been sewed to the tie 16 plus at least one stitch at which time the needle 10*b* and its thread arrives at the position X (FIG. 6) within the operative cutting range of the now extended carrier 60 with its thread cutter blade 60*g* and thread clamp 60*h*. A cam segment (not shown) drops a side lever of the machine 1 which actuates the pneumatic air cylinder 63 through line 63*a* via control 65, causing the piston 62 to be withdrawn with predetermined stroke, thereby retracting the carrier 60 via the carrier pin 60*d* and therewith the cutter blade 60*g* and the thread clamp 60*h* such that the forwardmost non-operative edge of the blade 60*g* and clamp 60*h* are substantially flush with the peripheral edge 25*a*, 25*b* of the clamp 25. This withdrawing action of the carrier 60 causes the thread 10*c* to be first clamped between the leading edge 60*h′* of the thread clamp blade 60*h* and the downwardly facing top surface 25*h* of clamp part 25*c* (FIG. 5). Immediately after the thread is clamped, the off-set cutting edge 60*g* of the thread cutting blade 60*g* cuts the thread 10*c* therebelow the clamped thread in cooperation with the edge of the cutting plate 67 (FIG. 5*a*) which is screwed by means of screws 67*a* to the bottom of the clamp part 25*c*. The cutting of the upper thread, in this manner by the upper thread blade 60*g* operatively mounted inside the liftable upper clamp part 25*b*, causes a cutting of the upper thread of the completely sewn neckband at the center of one of the elongated rectangular edges thereof and very close to the tie surface, approximately leaving only 1/16 of an inch end, providing a clean thread cut, presenting a nicely sewn neckband without hanging ends suited for high quality neckwear. Thereafter the large pneumatic cylinder 55*b* trips the lift lever 55 causing the lifting rod 55 and projection 54 to raise the pins 53 against the force of the clamping springs 58 and thus to lift open the upper clamp parts 25*c* and 25*d*. The bobbin thread is also substantially simultaneously cut by the cam operated trip control by means of the bobbin cutter blade 11*a*. When the next tie and neckband is positioned and clamped, the clamp 60*h* of the carrier 60 continues to clamp the thread for the first few stitches until the sewing passes the retracted carrier 60. Only thereafter is the carrier moved forwardly into the neckband opening of the clamp 25 into the operative-ready position for the next thread clamping and cutting when the tacking reaches its end position X.

In order to insure a close cutting of the upper thread relative to the tie and a particularly stable guide in cooperation therewith for fast acting machine operation, the carrier 60 is formed step-shaped by its integrally connected portions 60*a*, 60*c*, and 60*b*, respectively complementarily cooperating with channels 125*a*, 125*c* and edge 125*b*, respectively, in the clamp part 25*c*. The elongated slide portion 60*a* is the highest (closest to the actuating pneumatic cylinder 63) and is complementarily guided in the channel bottom 125*a* and between the channel side walls 125*a'* and 125*a''*, and the latter not being continuous with the bottom surface 125*a* of the channel in order to define therebetween an opening through which the lateral portion 60*c* of the carrier extends. The distance between the side walls 125*a'* and 125*a''* of the channel 125*a* are substantially equal to the width of the elongated slide portion 60*a* of the carrier 60. The top surface of the portion 60*a* is substantially flush with the top of the clamp 25*c* and the bottom of the cover 64 to complete the complementary slide channel.

The lateral portion 60*c* which connects the elongated slide portion 60*a* to the blade carrier portion 60*b* is of intermediate height and the blade carrier portion 60*b* is lowest so as to be closest to the tie 16 for a close upper thread cut to the tie. The lateral portion 60*c* is slidably guided in the channel 125*c* and between its bottom 125*c* and the top 125*c'* thereof, with its side surface 60*c'* which is adjacent but depending below the slide portion 60*a* abutting the intermediately downwardly stepped side 125*c''* of the channel formation. Accordingly the lateral portion 60*c* is complementarily sildably disposed on three sides thereof, namely, the bottom, its top (although shown in FIG. 7 slightly spaced from the top 125*c'* for clarity of illustration), and at its side 60*c'*. Its remaining side extends free into the opening 126 stepping integrally down to join the clamp and cutter blade carrier portion 60*b*, the latter having its side adjacent and facing the lateral portion 60*c* slidably abutting the lower vertical edge 125*b* of the channel formation. The front wall 127 (FIG. 8) forms a forward stroke abutment limit wall for the carrier slide portions 60*a* and 60*c*, and a rear abuttment wall 128 is formed vertically upwardly at the rear of the channel surface 125*c;* however it is to be noted that the adjustment nut 63*a* primarily serves as the foward and rear stroke limit for the movement of the carrier 60.

Referring now to FIGS. 10 – 12, another embodiment of an upper thread clamp and cutter blade carrier 160 is shown pivotally mounted in the upper clamp 25' by its therethrough pivotally extending pivot shaft 173, which is pivotally disposed in a pivot opening 173' in the upper clamp 25'. It is to be understood that although only the carrier 160, and a portion of the upper clamp 25' is shown, the clamp and cooperating portions may be formed as in FIGS. 1 – 9. The lower end of the shaft 173 has secured thereto the clamp blade 160*h* and the cutter blade 160*g* as in the previous embodiment by means of a screw 160*e*. The blades 160*h* and 160*g* cooperate as in the previous embodiment, in the recess means with the clamping edge 125*h* of the upper clamp 25' and the cutting plate 167, respectively, the latter being secured by screws 167*a* to the bottom of the clamp 25' extending slightly upwardly inclined toward the cutting blade 160*g* in the direction of its free end and being adjustably biased at its free end by a screw 75 extending from an opening 174 in the clamp so as to adjust the degree of contact cooperation of the cutting plate 167 with the cutting blade 160*g*. A lever 170 is secured to the pivot shaft 173 which enters an opening 170*a* of the lever 170 by a stud 90 passing through the shaft 173 and through both sides of the lever 170, and further tightened cooperatively together by a threaded screw 171 abutting the shaft 173. A piston arm 162 of a pneumatic cylinder 163 (corresponding in operation to that of cylinder 63 for the embodiment of FIGS. 1 – 9 and actuated by a control not here illustrated but similar to control 65 of FIG. 6) is connected to the other end of the lever by means of any suitable universal type linking member 91, whereby the lever 170 can be pivoted to move the blades 160*g* and 160*h* into the withdrawn position as indicated in dashed lines in FIG. 12 as well as into the operative position shown in full lines in FIGS. 11 and 12. The cylinder 163 is mounted to the clamp 25' in a suitable manner similar to the first embodiment and is thereby carried therewith the clamp 25' during the opening and closing movement of the clamp.

In operation at the beginning of the sewing, as the tacking passes adjacent the blades 160*h* and 160*g*, the pneumatic cylinder has already been actuated to pivotally retract the blades into the dashed line position, and after the tacking passes thereby, the carrier 160 of the blades is pivoted by the pneumatic cylinder 163 into the operative-ready position shown in full lines in FIG. 12. Subsequently the sewing completes the tacking about the entire periphery of the neckband (and the likewise rectangularly formed clamp opening, the tacking proceeding in the direction indicated by the arrows in FIG. 12 near the completion of the tacking) and stops at the position marked Y, whereby the pneumatic cylinder 163 is actuated so as to pivotally retract the blades from the full line operative position into the withdrawn dashed line position, consequently clamping and almost immediately thereafter cutting the needle thread as described in connection with the first embodiment.

While we have disclosed several embodiments of the invention, it is to be understood that these embodiments are given by example only and not in a limiting sense.

We claim:

1. In a tacking machine, an automatic necktie neckband tacker, comprising a gauge including inner peripheral edge means defining an opening substantially equal to the size of a neckband for securing a neckband therein adjacent an upper portion thereof, an upper clamp defining a clamp opening therein substantially equal to said opening of said gauge and aligned therewith, means movably disposing said upper clamp above said gauge and said upper clamp constituting a clamping means with said gauge for clamping therebetween a tie at a neck area thereof adjacent the neckband, a clamp and cutting blade carrier means for clamping and cutting, respectively, an upper needle thread, said upper clamp including guide means for guideably mounting said clamp and cutting blade carrier means for movement of the latter upon actuation thereof into a withdrawn position under said upper clamp, as well as into an operative position projecting into said clamp opening, pneumatic actuating means constituting a pneumatic cylinder operatively mounted on said upper clamp moveably jointly therewith, and for actuating said clamp and cutting blade carrier means.

2. The automatic necktie neckband tacker, as set forth in claim 1, wherein said guide means comprises recess means formed in said upper clamp forming three stepped channels in communication with one another including a highest channel, an intermediate channel and a lowest channel, the latter in communication with said clamp opening, said carrier means includes three integrally connected stepped portions substantially complementary in shape to and disposed in said three stepped channels, respectively, constituting an elongated slide portion displaceably disposed in said highest channel and a blade carrier portion disposed in said lowest channel, and a lateral portion disposed in said intermediate channel, a clamping blade and a cutting blade disposed on said blade carrier portion adjacent said clamp opening communicating therewith, and a cover disposed on said upper clamp adjacent said elongated slide portion and formed with an elongated opening adjacent said slide portion, the latter including a carrier pin extending therethrough, said pneumatic cylinder being secured to said cover and operatively connected to said carrier pin for moving said clamping blade and said cutting blade into and out of said clamp opening, respectively.

3. The necktie neckband tacker, as set forth in claim 1, wherein said inner peripheral edge means includes an edge extending downwardly in an outward direction and defining a lowermost edge of said gauge and an uppermost edge, a lower work plate secured to said gauge and having an inner peripheral edge aligned with said lowermost edge of said gauge and inclined therefrom inwardly downwardly at an acute angle relative to a horizontal plane and defining a lowermost portion further inwardly disposed relative to said uppermost edge of said inner peripheral edge means of said gauge, said upper clamp including an inner edge surface forming a lowermost vertical wall portion and an uppermost portion extending upwardly from said vertical wall portion in an outward direction, said vertical wall portion being substantially aligned with said lowermost portion of said lower work plate.

4. The necktie neckband tacker, as set forth in claim 3, wherein said upper clamp is formed in two inverted asymmetrically U-shaped portions facing each other including a longer clamp portion and a shorter clamp portion, and said guide means is formed in said longer clamp portion and includes stepped channels communicating with each other, said carrier means includes integrally connected stepped portions complementarily displaceably disposed in said stepped channels.

5. The necktie neckband tacker, as set forth in claim 4, wherein said U-shaped portions include U-legs having ends substantially adjacent a center of said upper clamp, foot means connected to one of said U-legs of each of said U-shaped portions for operatively opening said upper clamp away from said gauge, said recess means and said carrier means are located adjacent one of said ends of said longer clamp portion adjacent a corresponding of said foot means, and said pneumatic cylinder is mounted on said longer clamp portion at a portion thereof adjacent said corresponding foot means.

6. The necktie neckband tacker, as set forth in claim 1, further comprising displaceable tie abutments disposed adjustably on said gauge laterally away from said opening of said gauge and substantially adjacent and under said carrier means.

7. The necktie neckband tacker, as set forth in claim 1, wherein said guide means defines a pivot opening in said upper clamp and a recess means adjacent to said clamp opening, said carrier means includes a pivot shaft pivotally disposed in said pivot opening and a clamping blade and a cutting blade secured to said pivot shaft at one end thereof and disposed in said recess means adjacent to said clamp opening, as well as a lever secured to said pivot shaft above said upper clamp at one end of said lever, said pneumatic cylinder is operatively connected to the other end of said lever.

* * * * *